United States Patent [19]

King et al.

[11] 4,262,571

[45] Apr. 21, 1981

[54] GUIDE ASSEMBLY FOR USE IN SAWING AN ELONGATE MEMBER

[75] Inventors: Stanley King; Giles Henschel; Andrew Lawson, all of Henley on Thames, England

[73] Assignee: Stanley Tools Limited, Sheffield, England

[21] Appl. No.: 24,548

[22] Filed: Mar. 28, 1979

[30] Foreign Application Priority Data

Mar. 28, 1978 [GB] United Kingdom ..... 11881/78

[51] Int. Cl.[3] ..... B27G 5/02

[52] U.S. Cl. ..... 83/454; 83/522; 83/581; 83/762

[58] Field of Search ..... 83/454, 761–767, 83/821–829, 522, 581

[56] References Cited

U.S. PATENT DOCUMENTS

| | | | |
|---|---|---|---|
| 77,217 | 4/1868 | Robinson | 83/767 |
| 89,124 | 4/1869 | Burchell | 83/767 |
| 188,657 | 3/1877 | Mosher et al. | 83/765 |
| 252,987 | 1/1882 | Angus | 83/767 |
| 486,724 | 11/1892 | Marguard | 83/767 |
| 1,106,044 | 8/1914 | Hellman | 83/767 |
| 4,031,794 | 6/1977 | Leihgeber | 83/829 |

*Primary Examiner*—J. M. Meister

*Attorney, Agent, or Firm*—Prutzman, Kalb, Chilton & Alix

[57] ABSTRACT

A guide assembly for sawing an elongate member accurately to length to form the sides of a picture frame comprises two saw-guide units which are adjustably clamped to two guide roads by means of screws. The picture frame glass is placed between reference surfaces of blocks on the saw-guide units to determine the required distance apart of the two saw-guide units. Each saw-guide unit has two pairs of posts defining slots therebetween for the blade of a saw, to hold the saw-blade accurately at 45° to the direction of elongation of the wooden member, for the eventual formation of mitred joints between the sides of the picture frame. Each saw-guide unit includes a special ridge to abut that surface of the wooden member which is to surround the edge of the glass.

6 Claims, 3 Drawing Figures

GUIDE ASSEMBLY FOR USE IN SAWING AN ELONGATE MEMBER

DESCRIPTION

This invention relates to a guide assembly for use in sawing an elongate member. A particular application of the invention is to a guide assembly adapted for use in sawing an elongate wooden member of constant, shaped cross-section to accurate lengths for making a picture frame or the like.

As seen from one aspect of the invention there is provided a guide assembly for use in sawing an elongate member, comprising two saw-guide units and first means for rigidly interconnecting the two saw-guide units at a selectively variable distance apart, each saw-guide unit including respective second means for clamping the saw-guide unit to the elongate member and respective third means for maintaining the blade of a hand-held saw in a respective predetermined sawing plane relative to the respective saw-guide unit.

As seen from another aspect of the invention there is provided a method of using a guide assembly according to the first aspect of the invention, comprising the steps of using said first means to rigidly interconnect the two saw-guide units at a selected distance apart, using said second means to clamp each saw-guide unit to the elongate member and using said third means of each saw guide unit to maintain the saw blade in the respective sawing plane relative to the respective saw-guide unit while sawing the elongate member in two spaced apart places each corresponding to a respective one of the saw-guide units.

The invention will be described by way of example with reference to the accompanying drawings, wherein.

Figure 1:
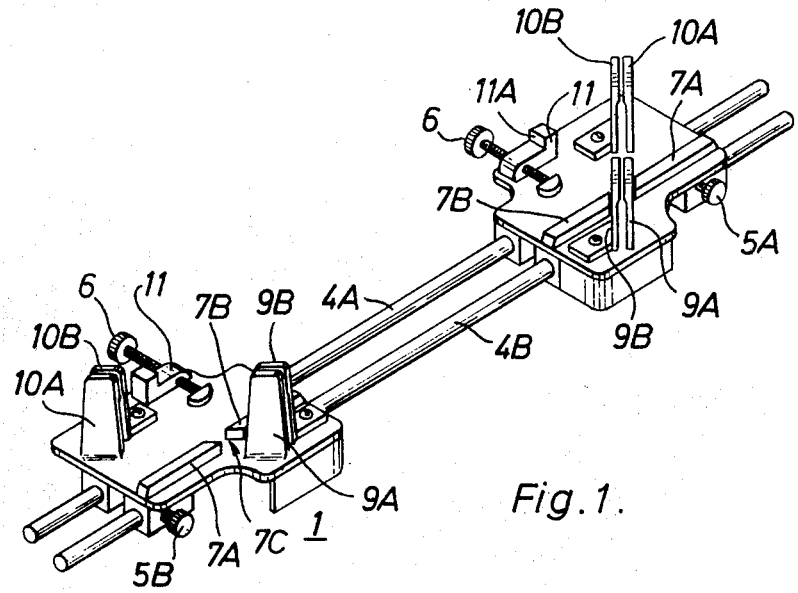
FIG. 1 is a perspective view of a guide assembly embodying the first aspect of the invention.

Referring to the drawings, the illustrated guide assembly 1 is adapted for use in sawing an elongate wooden member 2 of constant cross-section to an accurate length to form a side of a picture frame. The guide assembly 1 comprises two saw-guide units 3A and 3B which are identical, save that one is a mirror image of the other, which is most clearly apparent from FIG. 3. The guide assembly also includes a support which comprises two guide rods 4A and 4B, by means of which the two saw-guide units 3A and 3B can be rigidly interconnected at a selectively variable distance apart, for which purpose each saw-guide unit 3 comprises two knurled screws 5A and 5B for clamping the saw-guide unit 3 to the guide rod 4A, 4B respectively.

Figure 2:
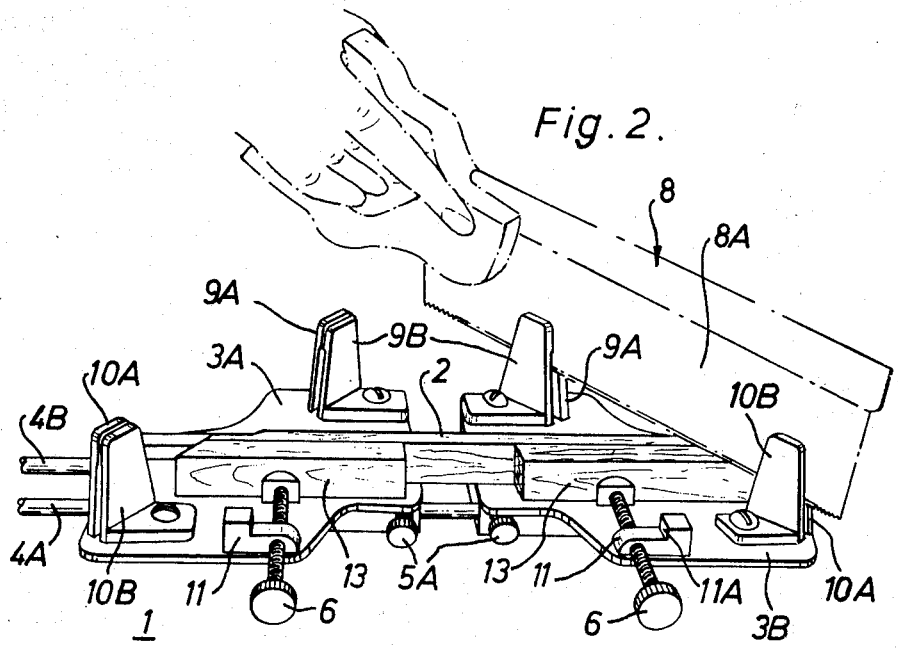
FIG. 2 is an illustration of the guide assembly of FIG. 1 being used in accordance with the second aspect of the invention.

Each saw-guide unit 3 comprises a clamping screw 6 for clamping the elongate member 2 against an abutment in the form of a ridge 7 which is divided into two parts 7A and 7B by a gap 7C which is provided for a saw 8, shown in phantom in FIG. 2.

Figure 3:
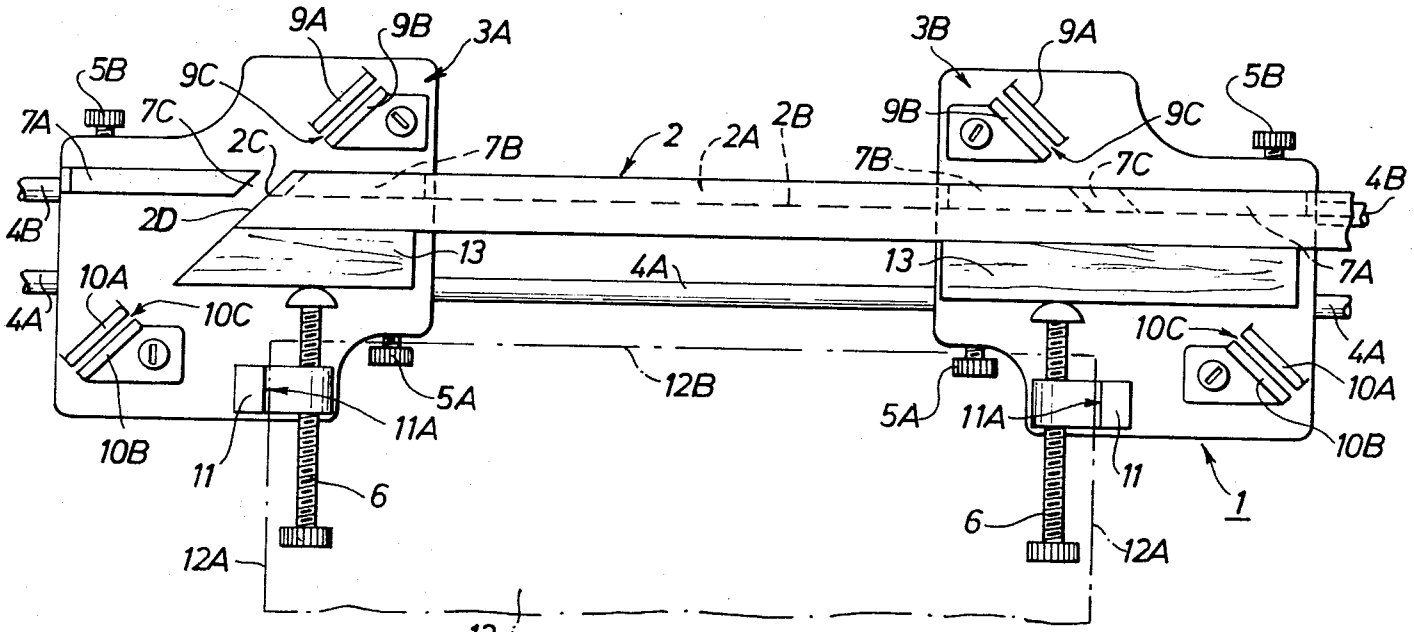
FIG. 3 is a plane view of the guide assembly of FIGS. 1 and 2, showing one side of a picture frame partly sawn to length and a sheet of glass for setting the length of the picture frame.

Each saw-guide unit 3 comprises two pairs of elements in the form of posts 9A, 9B and 10A, 10B arranged, as shown in FIGS. 2 and 3, with the posts 9A, 9B on one side and the posts 10A, 10B on the other side of the place where the elongate member 2 is arranged in use. Each pair of posts 9A, 9B and 10A, 10B defines a slot 9C and 10C respectively therebetween for the saw-blade 8A.

As shown most clearly in FIG. 3, but also apparent from FIGS. 1 and 2, the posts 9A, 9B and 10A, 10B are adapted to maintain the saw blade 8A at an angle of 45° relative to the direction of elongation of the elongate member 2, in order to form mitred joints between the four sides of the eventual picture frame (not shown).

For setting the required distance accurately between the two saw-guide units 3A and 3B, each saw-guide unit 3A, 3B is provided with a block 11 which, besides serving as a mounting for the clamping screw 6, also includes a reference surface 11A which, as shown in FIG. 3, is arranged to abut (or almost abut) a respective end 12A of a sheet of glass 12 for which the eventual picture frame is required.

The elongated wooden member 2 is of a standard, well-known constant cross-section having an undercut 2A so that the edge 12B of the sheet of glass 12 abuts (or almost abuts) an edge 2B of the member 2. For this reason, the reference surface 11A on the block 11 is arranged so that the end 12A of the sheet of glass, if extended, would intersect the edge 2B of the member 2 at 2C as shown in FIG. 3, that is to say, exactly at the place where the member 2 is sawn through.

To avoid marking the wooden member 2 with the clamping screw 6, it is preferred to interpose a piece of scrap wood 13 between the screw 16 and the member 2, as shown in FIGS. 2 and 3.

In use first of all the two saw-guide units 3A and 3B are set to the required distance apart on the guide rods 4A and 4B by placing the sheet of glass 12 between the reference surfaces 11A of the blocks 11 of the two saw-guide units 3A, 3B and the screws 5A and 5B of each saw-guide unit are tightened, so that the distance apart of the two saw-guide units is then fixed. The sheet of glass 12 can then be removed to a place of safety.

Then, the wooden member 12 and the two pieces of scrap wood 13 are placed in position, with the edge 2B of the elongate member 2 resting against the ridge parts 7A, 7B and the clamping screws 6 are tightened to clamp each saw-guide unit 3A, 3B to the elongate member 2.

Then, each end of the elongate member 2 is sawn in turn using the posts 9A, 9B and 10A, 10B to guide the sawblade 8A. In FIGS. 2 and 3 the elongate member 2 is shown with one end 2D already cut to length and with the other end not yet cut to length. Although FIG. 3 shows the position of the sheet of glass 12 in chain-dot lines, it will be appreciated that the sheet of glass is moved well out of the way during sawing, being no longer required.

We claim:

1. A guide assembly for use in sawing an elongate member having a longitudinal axis, comprising two saw-guide units, a support for rigidly interconnecting the two saw-guides units at a selectively variable distance apart, each saw-guide unit including means for guiding the blade of a saw in a predetermined sawing plane relative to the longitudinal axis of the elongate member, means for clamping the elongate member, and abutment means presenting a reference surface perpendicular to said longitudinal axis, said abutment means being positioned so that if extended, if would intersect said sawing plane on said longitudinal axis.

2. A guide assembly as claimed in claim 1 wherein said support comprises guide rod means and means for adjustably clamping at least one of the saw-guide units to the guide rod means.

3. A guide assembly as claimed in claim 1 wherein said guiding means is adapted to guide the saw blade at an acute angle relative to the longitudinal axis of the elongate member.

4. A guide assembly as claimed in claim 3 wherein the angle is 45°.

5. A guide assembly as claimed in claim 3 wherein the longitudinal axis of the elongate member is positioned intermediate its longitudinal edges.

6. A guide assembly as claimed in claim 1 wherein each said guiding means comprises two pairs of spaced posts arranged one pair on each side of the elongate member, each pair of elements defining a slot therebetween for the saw blade.

* * * * *